US005148559A

United States Patent [19]

Morris

[11] Patent Number: 5,148,559

[45] Date of Patent: Sep. 22, 1992

[54] PATIENT CONVEYANCE DEVICE

[76] Inventor: Charles W. Morris, Rte. 1, Box 66, Paris, Tenn. 38242

[21] Appl. No.: 682,308

[22] Filed: Apr. 9, 1991

[51] Int. Cl.[5] ..... A61G 5/00

[52] U.S. Cl. ..... 5/86.1; 5/81.1; 297/6; 297/349; 4/483

[58] Field of Search ..... 5/81.1, 86.1, 83.1, 5/85.1, 87.1; 4/480, 483; 297/5, 6, 349, 434, 440, DIG. 4; 280/250.1, 650

[56] References Cited

U.S. PATENT DOCUMENTS

| | | | |
|---|---|---|---|
| D. 292,076 | 9/1987 | Peters . | |
| 2,374,182 | 4/1945 | Duke . | |
| 2,673,987 | 4/1954 | Upshaw et al. | 5/86.1 |
| 2,759,525 | 8/1956 | Ries | 297/6 X |
| 2,792,951 | 5/1957 | White | 5/83.1 X |
| 3,272,530 | 9/1966 | Klassen . | |
| 3,654,643 | 4/1972 | Clanan . | |
| 3,788,695 | 1/1974 | Salem | 5/480 X |
| 3,940,808 | 3/1976 | Petrini | 5/83.1 |
| 3,951,449 | 4/1976 | Crowther | 297/349 X |
| 4,277,100 | 7/1981 | Beougher . | |
| 4,890,853 | 1/1990 | Olson . | |
| 4,964,182 | 10/1950 | Schmerler | 5/81.1 |

*Primary Examiner*—Michael F. Trettel
*Attorney, Agent, or Firm*—Walker, McKenzie & Walker

[57] ABSTRACT

A patient conveyance device for transporting a patient between first and second locations. The patient conveyance device includes a frame having a first side, a second side, and a front joining the front ends of the first and second sides to one another; and patient seat structure for being supported by the frame and for supporting the patient in a seated position; the patient seat structure being movably attached to the frame for allowing the patient seat structure to be moved between an opened position for allowing the patient to sit down onto the patient seat structure from a first location and to transfer from the patient seat structure to a second location, and a closed position for allowing the patient to be easily transported by the patient conveyance device.

15 Claims, 3 Drawing Sheets

PATIENT CONVEYANCE DEVICE

FIELD OF THE INVENTION

1. Field of the Invention

The present invention relates, in general, to a device for assisting in the transport of semi-ambulatory patients between beds, wheelchairs, etc., and bathroom facilities, etc.

2. Information Disclosure Statement

Numerous patient transport devices of many different configurations are known in the art. A preliminary patentability search in Design class 12, subclass 130; class 414, subclass 921; class 297, subclass 5; and class 4, subclass 480 produced the following patents:

Duke, U.S. Pat. No. 2,374,182, issued Apr. 24, 1945, discloses an invalid walker that is adjustable to different heights and positions for the convenience of users whether tall, short, stout or thin, and that is capable of supporting a user in a standing, sitting, or semi reclining position, etc.

Klassen, U.S. Pat. No. 3,272,530, issued Sep. 13, 1966, discloses a carrier for supporting an invalid for movement to and from his bed, chair, toilet stool or the like. The Klassen carrier has a removable seat rest that can be moved back over the structure on which an invalid is seated prior to being picked up by the carrier.

Clanan, U.S. Pat. No. 3,654,643, issued Apr. 11, 1972, discloses an invalid lift-transfer chair including a hydraulic lift for raising and lowering seat structure.

Beougher, U.S. Pat. No. 4,277,100, issued Jul. 7, 1981, discloses an invalid walker which includes a rigid frame carried by at least three wheels. A brake shoe cooperates with at least one of the wheels and is biased into engagement to limit movement of the walker unless the bias is manually overcome or locked out of engagement.

Olsen, U.S. Pat. No. 4,890,853, issued Jan. 2, 1990, discloses a wheelchair walker that provides for the seated support of the user and also enables the user to stand and walker with the assistance of the walker. The walker has a four wheel base, a hydraulic post for height adjustment, a bent U-shaped cloth covered frame for a patient seat support suspended from the hydraulic post, a retaining bar attachable to the frame, and a strap that extends between the user's legs and attaches to the retaining bar to secure the position of the user.

Peters, U.S. Pat. No. Des. 292,076, issued Sep. 29, 1987, discloses a walker including a pair of wheels and a seat.

None of the above patents disclose or suggest the present invention. More specifically, none of the above patents disclose or suggest a patient conveyance device including, in general, a frame having a first side, a second side, and a front joining the front ends of the first and second sides to one another; and patient seat means for being supported by the frame and for supporting the patient in a seated position; the patient seat means being movably attached to the frame for allowing the patient seat means to be moved between an opened position for allowing the patient to sit down onto the patient seat means from a first location and to transfer from the patient seat means to a second location, and a closed position for allowing the patient to be easily transported by the patient conveyance device.

SUMMARY OF THE INVENTION

Many types and configurations of patient transport devices are known. However, even with known patient transport devices, in most cases two attendants are required every four hours to assist one patient to and from restroom or shower facilities, etc. Such demands increase the possibility of injury to the patient and/or attendants.

The present invention overcomes difficulties of existing patient conveyance devices and addresses the specific problem of preventing the twisting of patients during maneuvering to and from bathroom facilities.

Many patients, even though semi-bedfast, are still able to help themselves to varied degrees. By incorporating a large amount of mobility, stability and safety, the present invention will greatly increase patient self-help, comfort and safety, and will lessen the task for the medical staff in assisting patients to and from bathroom facilities and the like.

The patient conveyance device of the present invention includes, in general, a frame having a first side, a second side, and a front joining the front ends of the first and second sides to one another; and patient seat means for being supported by the frame and for supporting the patient in a seated position; the patient seat means being movably attached to the frame for allowing the patient seat means to be moved between an opened position for allowing the patient to sit down onto the patient seat means from a first location and to transfer from the patient seat means to a second location, and a closed position for allowing the patient to be easily transported by the patient conveyance device.

DESCRIPTION OF THE PREFERRED EMBODIMENT

Figure 1:
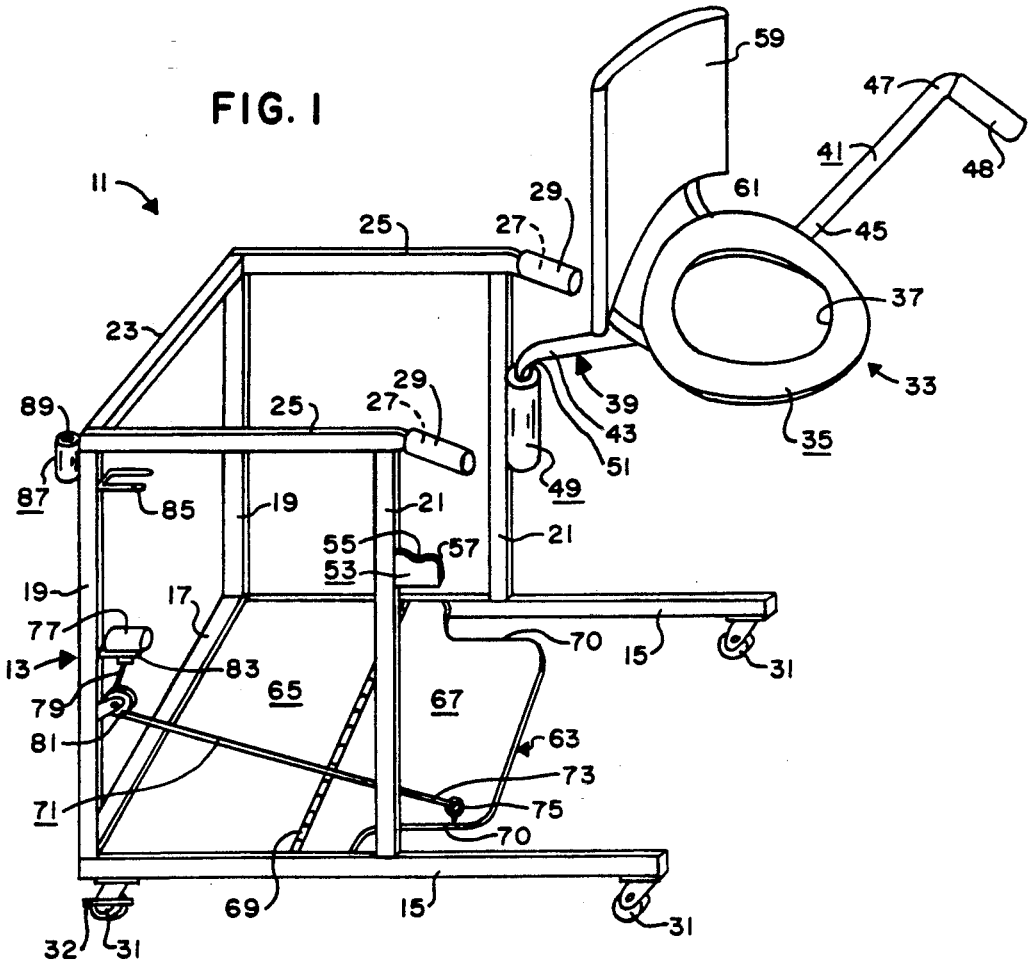
FIG. 1 is a perspective view of the patient conveyance device of the present invention in an opened position.

The preferred embodiment of the patient conveyance device of the present invention is shown in FIGS. 1-5 and identified by the numeral 11. The device 11 is intended primarily for the purpose of transporting semi-ambulatory hospital, nursing home or home bound patients from bed, wheelchair, straight-back chair, etc., to rest room facilities, shower, etc., and then back to the original location.

The device 11 includes a frame 13. The frame 13 preferably includes an open framework and preferably includes a pair of spaced apart lower rails 15 joined together at a first end by a lower cross member 17. A first upright member 19 preferably extends upward from the first end of each lower rail 15. A second upright member 21 preferably extends upward from a point substantially midway between the first and second ends of each lower rail 15. An upper cross member 23 preferably extends between the upper ends of each first upright member 19. An upper rail 25 preferably extends from the upper end of each first upright member 19 to and slightly past the upper end of each second upright member 21. The portion of each upper rail 25 that extends slightly past the respective second upright member 21 forms a hand grip portion 27 as will hereinafter become apparent. The various rails and members of the frame 13 are preferably formed out of tubular steel and welded to one another to form a rigid, strong unit as will now be apparent to those skilled in the art. Plastic or rubber hand grips 29 are preferably secured to the hand grip portion 27 of each upper rail 25. The hand grips 29 may consist of typical bicycle hand grips or the like well known to those skilled in the art. The hand grips portions 27 and hand grips 29 may be gripped by both the patient and the attendant assisting the patient on and off of the device 11. The upper portion of the frame 13 and the hand grips 29 provide the patient with necessary stability for their physical needs along with a mental sense of security.

The device 11 preferably includes means for rollably supporting the frame 13. The means for rollably supporting the frame 13 preferably includes a typical swivel caster 31 or the like attached to the each end of each lower rail 15 as will now be apparent to those skilled in the art. The swivel casters 31 attached to the forward end of each lower rail 15 are preferably equipped with standard foot operated locking mechanisms 32.

Figure 2:
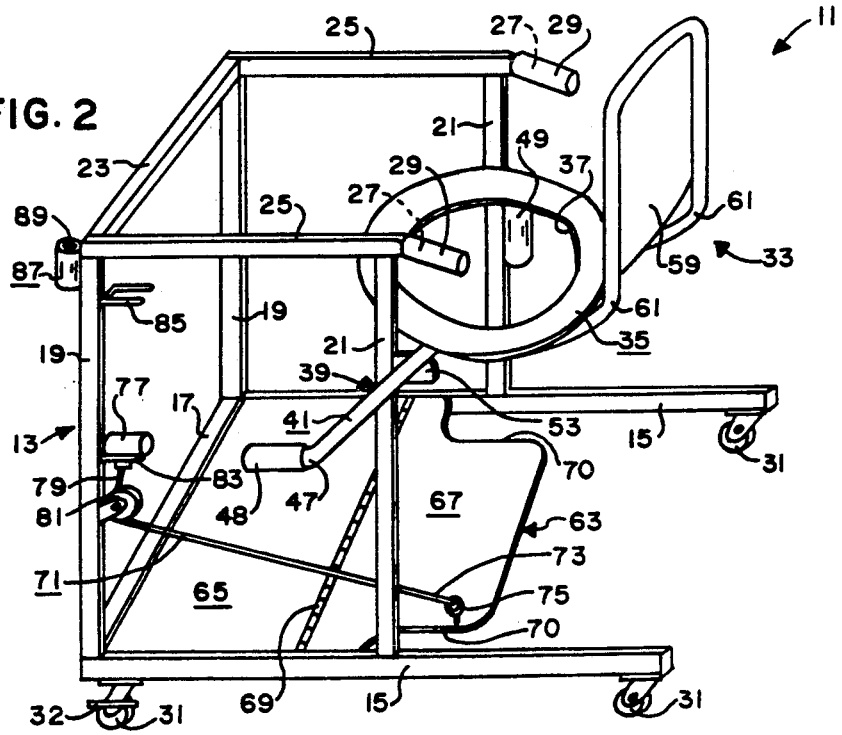
FIG. 2 is a perspective view of the patient conveyance device of the present invention in a closed position.

The device 11 includes patient seat means 33 for being supported by the frame 13 and for supporting a patient in a sitting position. The patient seat means 33 is movably attached to the frame 13 in such a manner to allow the patient seat means 33 to be moved between an opened position as shown in FIG. 1 for allowing the patient to easily sit down onto the patient seat means 33 and transfer from the patient seat means 33 onto some other support or the like, and a closed position as shown in FIG. 2 for allowing the patient to be easily transported by the device 11. The patient seat means 33 preferably includes a seat member 35 for allowing the patient to sit thereon. The seat member 35 preferably has an opening 37 therethrough for allowing the device 11 to be used as a toilet chair or the like as will now be apparent to those skilled in the art. Thus, the seat member 35 preferably consists of a typical commode, toilet or water closet seat having a central opening therethrough as will now be apparent to those skilled in the art.

The patient seat means 33 preferably includes attaching means 39 for pivotally attaching the seat member 35 to the frame 13. The attaching means 39 preferably includes a rigid arm member 41 and a plate member 42. The arm member 41 has a first end 43 for being pivotally attached to one of the second upright members 21, a midportion 45 for being attached to and supporting the seat member 35, and a second end 47. The arm member 41 is preferably formed out of tubular steel and screwed or otherwise fixedly attached to the seat member 35 and the plate member 42 to form a rigid, strong unit as will now be apparent to those skilled in the art. The arm member 41 is preferably bent or otherwise formed into the shape indicated in the drawings with the first end 43 thereof bent downward at an approximately 90 degree angle to form a vertical pivot member as will hereinafter become apparent. The second end 47 of the arm member 41 is preferably bent sidewise at an approximately 90 degree angle. The arm member 41 is preferably fabricated from solid steel round stock. The plate member 42 is preferably constructed out of a flat steel plate in a generally oval shape with a central opening therethrough and which generally corresponds to the bottom of the seat member 35 for allowing the plate member 42 to be screwed or otherwise fixedly attached to the bottom of the seat member 35 without blocking any portion of the opening 37 through the seat member 35. The plate member 42 is preferably welded or otherwise secured to the midportion 45 of the arm member 41 to form a rigid, strong unit that can support weights in excess of 300 pounds and that can be easily detached from the frame 13 if desired or required.

A plastic or rubber hand grip 48 is preferably secured to the second end 47 of the arm member 41 for allowing a user to securely grip the arm member 41. The hand grip 48 may consist of a typical bicycle hand grip or the like well known to those skilled in the art.

A hollow sleeve 49 is preferably fixedly attached to one of the second upright members 21 of the frame 13 with the aperture 51 through the sleeve 49 located in a generally vertical position. The distal portion of the bent first end 43 of the arm member 41 can be inserted down into the aperture 51 of the sleeve 49 in such a manner to allow the arm member 41 and, thus, the seat member 35 to be pivoted between the opened and closed positions and to allow the patient seat means 33 and arm member 41 to be easily detached from the frame 13 by merely lifting the first end 43 of the arm member 41 out of the aperture 51 as will now be apparent to those skilled in the art. The sleeve 49 is preferably constructed from a length of typical metal tube or the like welded or otherwise fixedly attached to the respective second upright member 21 as will now be apparent to those skilled in the art.

A keeper means 53 is preferably attached to the other second upright member 21 as clearly shown in FIGS. 1 and 2 for holding the patient seat means 33 in the closed position. More specifically, the keeper means 53 preferably has a notch 55 therein for receiving a portion of the second end 47 of the arm member 41 when the patient seat means 33 is in the closed position and for requiring force to be applied to the patient seat means 33 to remove the portion of the second end 47 of the arm member 41 from the notch 55. The keeper means 53 is preferably positioned on the respective second upright member 21 so that the portion of the second end 47 of the arm member 41 will rest in the notch 55 when the patient seat means 33 is in the closed position. The keeper means 53 preferably has a cam surface 57 thereon for urging a portion of the second end 47 of the arm member 41 to the notch 55 when the patient seat means 33 is moved from the opened position to the closed position. More specifically, the cam surface 57 engages and slightly raises the second end 47 of the arm member 41 as the patient seat means 33 is moved from the opened position to the closed position to thereby urge a portion of the second end 47 of the arm member 41 upward and into the notch 55 as will now be apparent to those skilled in the art. The keeper means 53 is preferably constructed from a rigid metal plate welded or otherwise fixedly attached to the respective second upright member 21 and with the notch 55 and cam surface 57 machined or otherwise formed therein.

The patient seat means 33 preferably includes a back rest 59 attached relative to the seat member 35 for supporting the patient's back and to provide patient comfort, security and stability. The back rest 59 may include tubular framework and a vinyl or fabric cover fitted to the tubular framework. The back rest 59 is preferably secured relative to the seat member 35 by metal tubing 61 or the like extending between the back rest 59 and the arm member 41 with the back rest 59 screwed or otherwise fixedly attached to one end of the metal tubing 61 and with the other end of the metal tubing 61 welded or otherwise fixedly attached to the arm member 41.

It should be noted that the device 11 can be designed with the patient seat means 33 pivotally attached to either the right or left side of the frame 13, i.e., to either the right or left second upright member 21, as will now be apparent to those skilled in the art.

The device 11 preferably includes base means 63 for supporting the patient's feet and for allowing the patient to stand thereon. The base means 63 preferably includes a stationary base plate 65 fixedly and non-movably attached to the frame 13. The stationary base plate 65 is preferably constructed from a substantially rectangular piece of rigid steel plate, approximately 6.35 millimeters (0.25 inch) thick, welded or otherwise fixedly attached to the forward ends of the lower rails 15 and the lower cross member 17 of the frame 13. The stationary base plate 65 serves as reinforcement for the frame 13 and acts as a foot rest for the patient when the patient is in a seated position.

Figure 3:
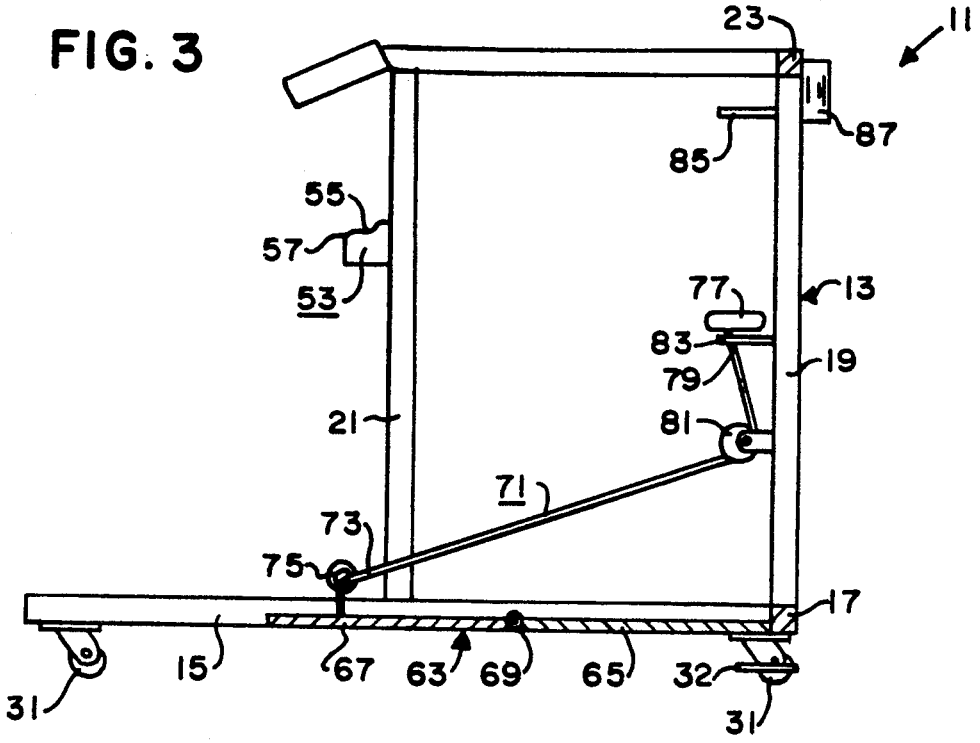
FIG. 3 is a sectional view of the patient conveyance device of the present invention substantially as taken on line 3—3 of FIG 1.
Figure 4:
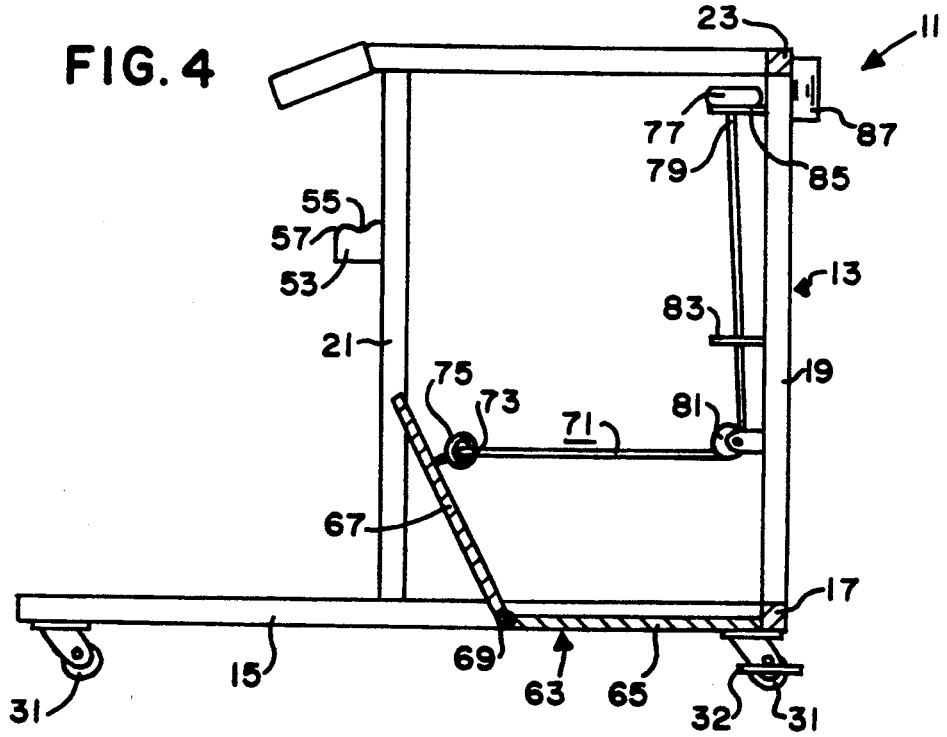
FIG. 4 is a sectional view similar to FIG. 3 but with a portion of the patient conveyance device of the present invention in a raised position.
Figure 5:
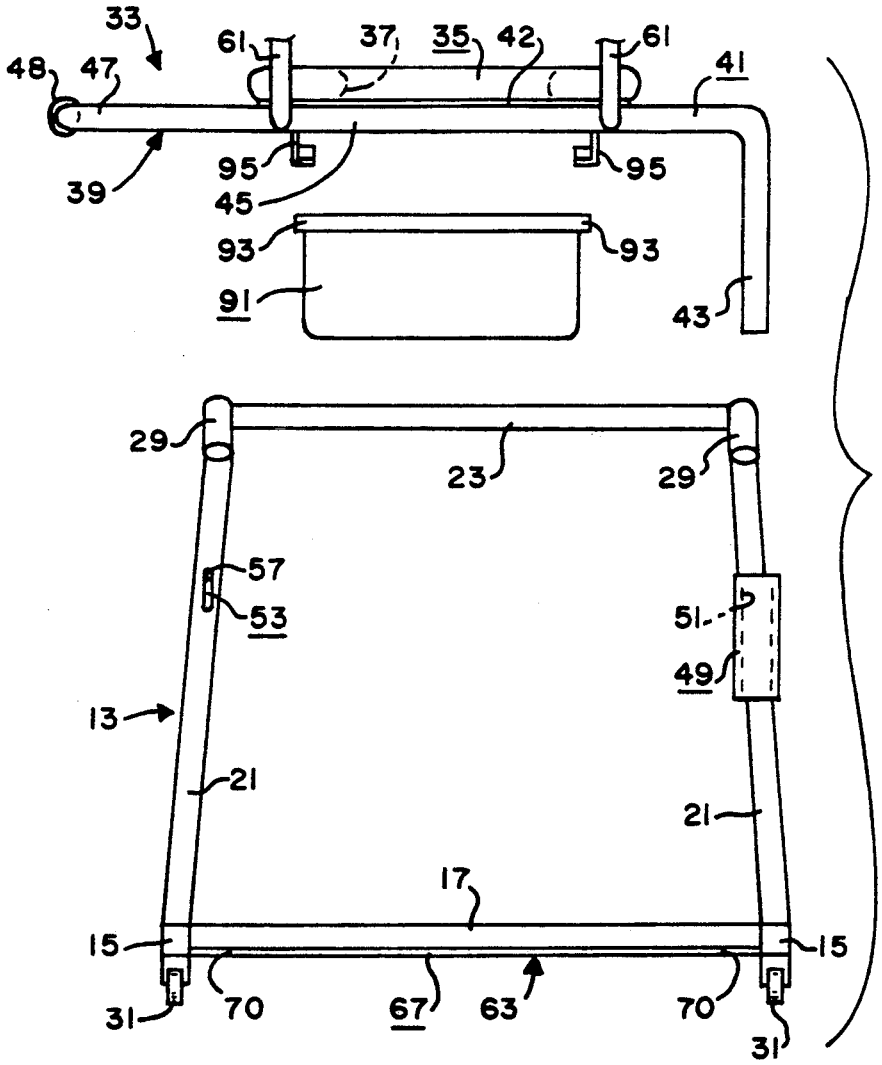
FIG. 5 is an exploded rear elevational view of the patient conveyance device of the present invention.

The base means 63 preferably includes a movable base plate 67 for movement between a lowered position as shown in FIGS. 1, 2 and 3, and a raised position as shown in FIG. 4. The raised or upright position provides the necessary clearance to allow the device 11 to be positioned over (i.e., backed over) a standard commode or the like and position the opening 37 through the seat member 35 directly over the commode, etc., as will now be apparent to those skilled in the art. The movable base plate 67 is also preferably constructed from a substantially rectangular piece of rigid steel plate, approximately 6.35 millimeters (0.25 inch) thick. However, the forward edge of the movable base plate 67 is preferably movably attached to the rearward edge of the stationary base plate 65 by a hinge 69 such as a typical piano hinge or the like for allowing the movable base plate 67 to be easily moved between the lowered and raised positions. The movable base plate 67 is preferably constructed so that rearward opening slots 70 are provided between each side thereof and the lower rails 15 to receive the front wheels, etc., of a standard wheelchair or the like while the movable base plate 67 is in the lowered position. The slots 70 facilitate the transfer of a patient between a standard wheelchair and the device 11 by allowing the wheelchair to be rolled toward the front of the device 11 until the front wheels of the wheelchair are located in the slots 70 whereby the patient's feet will be substantially centered over the base means 63. The patient may physically stand upon both the stationary base plate 65 and the movable base plate 67 during loading and unloading procedures. As an alternate configuration, the movable base plate 67 may include separate right and left halves with each hall pivotally attached to the respective lower rail 15 to allow the movable base plate 67 to move outwardly toward each side of the frame 13 rather than toward the front of the frame 13 and to thereby allow free egress onto and off of the stationary base plate 65 when in the raised position. This alternate arrangement allows the device 11 to be easily used as a walker and increases the versatility of the device 11.

A cable 71 is preferably provided for allowing the user of the device 11 to easily move the movable base plate 67 from the lowered position to the raised position. The first end 73 of the cable 71 is preferably attached to the movable base plate 67 adjacent the rearward edge thereof by an eyebolt 75 or the like. A pull handle 77 is preferably attached to the second end 79 of the cable 71 to allow the user of the device 11 to manually pull the cable 71 to move the movable base plate 67 from the lowered position to the raised position as will now be apparent to those skilled in the art. A pulley 81 or the like is preferably provided to guide the cable 71. The pulley 81 is preferably attached to one of the first upright members 19 of the frame 13 through a swivel or the like. A first pull handle keeper 83 is preferably attached to the frame 13 for holding the pull handle 77 when the movable base plate 67 is in the lowered position. A second pull handle keeper 85 is preferably attached to the frame 13 for holding the pull handle 77 when the movable base plate 67 is in the raised position. Each pull handle keeper 83, 85 may be constructed out of rigid metal in a generally U-shape and welded or otherwise fixedly attached to one of the first upright members 19 in a spaced-apart relationship as clearly shown in the drawings.

A hollow sleeve 87 is preferably fixedly attached to one of the first upright members 19 of the frame 13 with the aperture 89 through the sleeve 87 located in a generally vertical position for holding a typical I.V. pole or the like to provide mobility for a typical I.V. apparatus as may be required for patient therapy and as will now be apparent to those skilled in the art.

The device 11 preferably includes a bedpan 91 and means for holding the bedpan 91 or other such waste container directly beneath the opening 37 in the seat member 35 and thus allow the device 11 to be used as a portable commode facility. More specifically, the sides of the bedpan 91 are preferably provided with flanges 93 and a pair of opposing channels 95 are preferably fixedly attached to the underside of the seat member 35, the plate member 42 and/or arm member 41 on opposite sides of the opening 37 through the seat member 35 for slidably receiving the flanges 93 of the bedpan 91. The channels 95 may be constructed from typical metal channel members welded or otherwise fixedly attached to the plate member 42, etc. The end of each channel 95 located toward the rear of the seat member 35 is preferably provided with a downwardly sloped cam portion or the like to allow the respective flange 93 to be easily slid into the respective channel 95 as will now be apparent to those skilled in the art. The end of each channel 95 toward the front of the seat member 35 may be provided with a stop to prevent the bedpan 91 from sliding past the opening 37 as will now be apparent to those skilled in the art.

The device 11 may include various harnessing and lifting devices (not shown) or the like for use to help stabilize the patient, etc., as will now be apparent to those skilled in the art. Such harnessing devices may be of many varied configurations as will now be apparent to those skilled in the art.

To transfer a patient onto the device 11 from a bed, the patient seat means 33 and arm member 41 are swung to the opened position and the movable base plate 67 is positioned in the lowered position. The patient is allowed to sit upright in bed with his or her feet hanging over the side of the bed toward the floor. The device 11 is rolled toward the bed with the patient's legs substantially centered between the opposite sides of the device 11 until the rearward ends of the lower rails 15 extend underneath the bed and the second upright members 21 engage the side of the bed or the bed rails and the opposite sides of the device 11 straddle the patient's legs. The patient can then place his or her feet onto the base means 63 and stand up, with assistance if necessary. For example, a strap or belt may be placed around the patient's chest for being pulled on gently by an attendant as the patient moves from a sitting to a standing position, etc. The device 11, with the patient aboard, can then be pulled away from the bed until sufficient room is provided for swinging the patient seat means 33 to the closed position. The patient seat means 33 is then swung around by an attendant to the closed position until it is all the way underneath the patient and until the second end 47 of the arm member 41 engages the keeper means 53. The patient can then sit down on the seat member 35. The patient's feet will then be supported on the stationary base plate 65 and the movable base plate 67 can be lifted to and locked in the raised position. That is, the pull handle 77 can be lifted by an attendant from the lowered position on the first pull handle keeper 83 to the raised position on the second pull handle keeper 85 to thereby raise the movable base plate 67 to a position of approximately 70 degrees. The pull handle 77 can then be placed in the second pull handle keeper 85 to hold the movable base plate 67 in the raised position until the pull handle 77 is manually moved from the second pull handle keeper 85. The device 11 with the patient securely seated thereon, can then be positioned over a commode or the like. Transfer of a patient from the device 11 back onto a bed is accomplished by reversing the above procedures.

To transfer a patient onto the device 11 from a standard wheelchair, the movable base plate 67 is positioned in the lowered position and the wheelchair (or the device 11) is rolled between the lower rails 15 toward the front of the device 11 until the front wheels of the wheelchair are positioned in the slots 70 of the movable base plate 67 and the opposite sides of the device 11 straddle the patient's legs. The patient can then place his or her feet onto the base means 63 and stand up with assistance if necessary. For example, a strap or belt may be placed around the patient's chest for being pulled on gently by an attendant as the patient moves from a sitting to a standing position, etc. The wheelchair can then be rolled back and out of the way. The patient seat means 33 is then swung around by an attendant to the closed position and until it is all the way underneath the patient and until the second end 47 of the arm member 41 engages the keeper means 53. The patient can then sit down on the seat member 35. Transfer of a patient from the device 11 back into a wheelchair is accomplished by reversing the above procedures.

The preferred embodiment of the present invention provides a patient conveyance device 11 including a strong frame equipped with swivel casters which allows total mobility and allows the device to turn 360 degrees in its own circumference. The patient is always in a forward position and is never twisted when being transferred to or from the patient conveyance device 11. The movable base plate 67 and the slots 70 allow a patient to be transferred to and from the patient conveyance device 11 at such time as desired or needed, no matter where the patient is located.

Although the present invention has been described and illustrated with respect to a preferred embodiment and a preferred use therefore, it is not to be so limited since modifications and changes can be made therein which are within the full intended scope of the invention.

I claim:

1. A patient conveyance device for transporting a patient between first and second locations, said patient conveyance device comprising:

a) a frame having a first side, a second side, and a front joining the front ends of said first and second sides to one another; and b) patient seat means for being supported by said frame and for supporting the patient in a seated position; said patient seat means being movably attached to said frame for allowing said patient seat means to be moved between an opened position for allowing the patient to sit down onto said patient seat means from a first location and to transfer from said patient seat means to a second location, and a closed position for allowing the patient to be easily transported by said patient conveyance device; said patient seat means including a seat member, said seat member having a central opening therethrough for allowing said patient conveyance device to be used as a toilet chair; said patient seat means including attaching means for pivotally attaching said seat member to said frame; said attaching means including an arm member having a first end for being pivotally attached to said frame, having a midportion for supporting said seat member, and having a second end.

2. The patient conveyance device of claim 1 in which said attaching means includes a plate member positioned between said seat member and said midportion of said arm member of said attaching means.

3. The patient conveyance device of claim 1 in which is included a hollow sleeve fixedly attached to said frame, and in which said first end of said arm member of said attaching means is bent downward at an approximately 90 degree angle for being inserted into said sleeve.

4. The patient conveyance device of claim 1 in which is included keeper means attached to said frame for holding said patient seat means in said closed position.

5. The patient conveyance device of claim 4 in which said keeper means has a notch for receiving a portion of said second end of said arm member of said attaching means when said patient seat means is in said closed position.

6. The patient conveyance device of claim 5 in which said keeper means has a cam surface for urging a portion of said second end of said arm member of said attaching means to said notch when said patient seat means is moved from said opened position to said closed position.

7. The patient conveyance device of claim 6 in which said patient seat means includes a back rest attached relative to said seat member for supporting the patient's back and to provide patient comfort, security and stability.

8. A patient conveyance device for transporting a patient between first and second locations, said patient conveyance device comprising:

(a) a frame having a first side, a second side, and a front joining the front ends of said first and second sides to one another;

(b) patient seat means for being supported by said frame and for supporting the patient in a seated position; said patient seat means being movably attached to said frame for allowing said patient seat means to be moved between an opened position for allowing the patient to sit down onto said patient seat means from a first location and to transfer from said patient seat means to a second location, and a closed position for allowing the patient to be easily transported by said patient conveyance device; said patient seat means including a seat member, said seat member having a central opening therethrough for allowing said patient conveyance device to be used as a toilet chair; and (c) base means for supporting the patient's feet and for allowing the patient to stand thereon; said base means including a stationary base plate fixedly and non-movably attached to said frame.

9. The patient device of claim 8 in which said base means includes a movable base plate for movement between a lowered position and a raised position, said movable base plate providing support for the patient's feet when in said lowered position and providing the necessary clearance to allow said patient conveyance device to be positioned over a standard commode when in the raised position.

10. The patient conveyance device of claim 9 in which said movable base plate is pivotally attached to said stationary base plate.

11. The patient conveyance device of claim 10 in which is included a cable having a first end attached to said movable base plate and having a second end for being pulled to move said movable base plate from said lowered position to said raised position.

12. The patient conveyance device of claim 11 in which is included a pull handle attached to said second end of said cable for allowing said second end of said cable to be manually pulled to move said movable base plate from said lowered position to said raised position; in which is included a first pull handle keeper attached to said frame for holding said pull handle when said movable base plate is in said lowered position; and in which is included a second pull handle keeper attached to said frame for holding said pull handle when said movable base plate is in said raised position.

13. A patient conveyance device for transporting a patient between first and second locations, said patient conveyance device comprising:

a) a frame having a first side, a second side, and a front joining the front ends of said first and second sides to one another;

b) patient seat means for being supported by said frame and for supporting the patient in a seated position; said patient seat means being movably attached to said frame for allowing said patient seat means to be moved between an opened position for allowing the patient to sit down onto said patient seat means from a first location and to transfer from said patient seat means to a second location, and a closed position for allowing the patient to be easily transported by said patient conveyance device; said patient seat means including a seat member, said seat member having a central opening therethrough for allowing said patient conveyance device to be used as a toilet chair; said patient seat means including attaching means for pivotally attaching said seat member to said frame; said attaching means including an arm member having a first end for being pivotally attached to said frame, having a midportion for supporting said seat member, and having a second end;

c) a hollow sleeve fixedly attached to said frame; said first end of said arm member of said attaching means being bent downward at an approximately 90 degree angle for being inserted into said sleeve;

d) keeper means attached to said frame for holding said patient seat means in said closed position; said keeper means having a notch for receiving a portion of said second end of said arm member of said attaching means when said patient seat means is in said closed position; and e) base means for supporting the patient's feet and for allowing the patient to stand thereon; said base means including a stationary base plate fixedly and non-movably attached to said frame and including a movable base plate for movement between a lowered position and a raised position, said movable base plate providing support for the patient's feet when in said lowered position and providing the necessary clearance to allow said patient conveyance device to be positioned over a standard commode when in the raised position.

14. A patient conveyance device for transporting a patient between first and second locations, said patient conveyance device comprising:

a) a frame having a first side, a second side, and a front joining the front ends of said first and second sides to one another; and b) patient seat means for being supported by said frame and for supporting the patient in a seated position; said patient seat means being movably attached to said frame for allowing said patient seat means to be moved between an opened position for allowing the patient to sit down onto said patient seat means from a first location and to transfer from said patient seat means to a second location, and a closed position for allowing the patient to be easily transported by said patient conveyance device; said patient seat means including a seat member; said patient seat means including attaching means for pivotally attaching said seat member to said frame; said attaching means including an arm member having a first end for being pivotally attached to said frame, having a midportion for supporting said seat member, and having a second end.

15. A patient conveyance device for transporting a patient between first and second locations, said patient conveyance device comprising:

a) a frame having a first side, a second side, and a front joining the front ends of said first and second sides to one another;

b) patient seat means for being supported by said frame and for supporting the patient in a seated position; said patient seat means being movably attached to said frame for allowing said patient seat means to be moved between an opened position for allowing the patient to sit down onto said patient seat means from a first location and to transfer from said patient seat means to a second location, and a closed position for allowing the patient to be easily transported by said patient conveyance device; said patient seat means including a seat member; and c) base means for supporting the patient's feet and for allowing the patient to stand thereon; said base means including a stationary base plate fixedly and non-movably attached to said frame.

* * * * *